US006932581B2

(12) United States Patent
Messick

(10) Patent No.: US 6,932,581 B2
(45) Date of Patent: Aug. 23, 2005

(54) GAS LIFT VALVE

(75) Inventor: Tyson R. Messick, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/393,558

(22) Filed: Mar. 21, 2003

(65) Prior Publication Data

US 2004/0182437 A1 Sep. 23, 2004

(51) Int. Cl.[7] ..... E21B 34/06
(52) U.S. Cl. ..... 417/54; 137/155; 417/112
(58) Field of Search ..... 137/155; 417/54, 417/112

(56) References Cited

U.S. PATENT DOCUMENTS

| | | | | |
|---|---|---|---|---|
| 2,385,316 A | * | 9/1945 | Walton | 137/155 |
| 2,797,700 A | * | 7/1957 | McGowen, Jr. | 137/155 |
| 3,124,151 A | * | 3/1964 | Lilly | 137/155 |
| 4,592,380 A | | 6/1986 | Hamm | |
| 5,707,214 A | | 1/1998 | Schmidt | |
| 5,743,717 A | | 4/1998 | Schmidt | |
| 5,782,261 A | | 7/1998 | Becker et al. | |
| 5,806,598 A | | 9/1998 | Amani | |
| 5,896,924 A | | 4/1999 | Carmody et al. | |
| 5,937,945 A | | 8/1999 | Bussear et al. | |
| 5,971,004 A | | 10/1999 | Pringle | |
| RE36,566 E | | 2/2000 | Pringle | |
| 6,070,608 A | | 6/2000 | Pringle | |
| 6,176,309 B1 | | 1/2001 | Bender | |
| 6,305,402 B2 | | 10/2001 | Pringle | |
| 2001/0025651 A1 | | 10/2001 | Almeida | |
| 2002/0070369 A1 | | 6/2002 | Faustinelli | |
| 2002/0096332 A1 | | 7/2002 | De Almeida | |

FOREIGN PATENT DOCUMENTS

| | | |
|---|---|---|
| EP | 0 745 176 B1 | 4/1998 |
| SU | 440482 A | 8/1974 |
| SU | 973798 A | 11/1982 |
| WO | WO 02/059485 A1 | 8/2002 |

* cited by examiner

*Primary Examiner*—Gerald A. Michalsky
(74) *Attorney, Agent, or Firm*—Trop, Pruner & Hu, P.C.; Bryan P. Galloway; Jaime A. Castano

(57) ABSTRACT

A gas lift valve that is usable with a subterranean well includes a housing, a valve stem and at least one bellows. The housing has a port that is in communication with a first fluid, and the valve stem is responsive to the first fluid to establish a predefined threshold to open the valve. The bellow(s) form a seal between the valve stem and the housing. The bellow(s) are subject to a force that is exerted by the first fluid; and a second fluid contained in the bellow(s) opposes the force that is exerted by the first fluid.

50 Claims, 6 Drawing Sheets

GAS LIFT VALVE

BACKGROUND

The invention generally relates to a gas lift valve.

For purposes of communicating well fluid to a surface of a well, the well may include a production tubing. More specifically, the production tubing typically extends downhole into a wellbore of the well for purposes of communicating well fluid from one or more subterranean formations through a central passageway of the production tubing to the surface of the well. Due to its weight, the column of well fluid that is present in the production tubing may suppress the rate at which the well fluid is produced from the formation. More specifically, the column of well fluid inside the production tubing exerts a hydrostatic pressure that increases with well depth. Thus, near a particular producing formation, the hydrostatic pressure may be significant enough to substantially slow down the rate at which the well fluid is produced from the formation.

For purposes of reducing the hydrostatic pressure and thus, enhancing the rate at which fluid is produced, an artificial-lift technique may be employed. One such technique involves injecting gas into the production tubing to displace some of the well fluid in the tubing with lighter gas. The displacement of the well fluid with the lighter gas reduces the hydrostatic pressure inside the production tubing and allows reservoir fluids to enter the wellbore at a higher flow rate. The gas to be injected into the production tubing typically is conveyed downhole via the annulus (the annular space surrounding the production tubing) and enters the production tubing through one or more gas lift valves.

As an example, FIG. 1 depicts a gas lift system 10 that includes a production tubing 14 that extends into a wellbore. For purposes of gas injection, the system 10 includes a gas compressor 12 that is located at the surface of the well for purposes of introducing pressurized gas into an annulus 15 of the well. To control the communication of gas between the annulus 15 and a central passageway 17 of the production tubing 14, the system 10 may include several gas lift mandrels 16 (gas lift mandrels 16*a*, 16*b* and 16*c*, depicted as examples). Each one of these gas lift mandrels 16 includes an associated gas lift valve 18 (gas lift valves 18*a*, 18*b* and 18*c*, depicted as examples) that responds to the annulus pressure. More specifically, when the annulus pressure at the gas lift valve 18 exceeds a predefined threshold, the gas lift valve 18 opens to allow communication between the annulus 15 and the central passageway 17. For an annulus pressure below this threshold, the gas lift valve 16 closes and thus, prevents communication between the annulus 15 and the central passageway 17.

It is typically desirable to maximize the number of cycles in which each gas lift valve 18 may be opened and closed, as the cost of the gas lift valves 18 may be a significant component of the overall production costs. The number of times that a gas lift valve may be opened and closed may be a function of the loading that is experienced by the various seals of the gas lift valve 18.

SUMMARY

In an embodiment of the invention, a gas lift valve that is usable with a subterranean well includes a housing, a valve stem and at least one bellows. The housing has a port that is in communication with a first fluid, and the valve stem is responsive to the first fluid to establish a predefined threshold to open the valve. The bellow(s) form a seal between the valve stem and the housing. The bellow(s) are subject to a force that is exerted by the first fluid; and a second fluid contained in the bellow(s) opposes the force that is exerted by the first fluid.

Advantages and other features of the invention will become apparent from the following description, drawing and claims.

DETAILED DESCRIPTION

Figure 1:
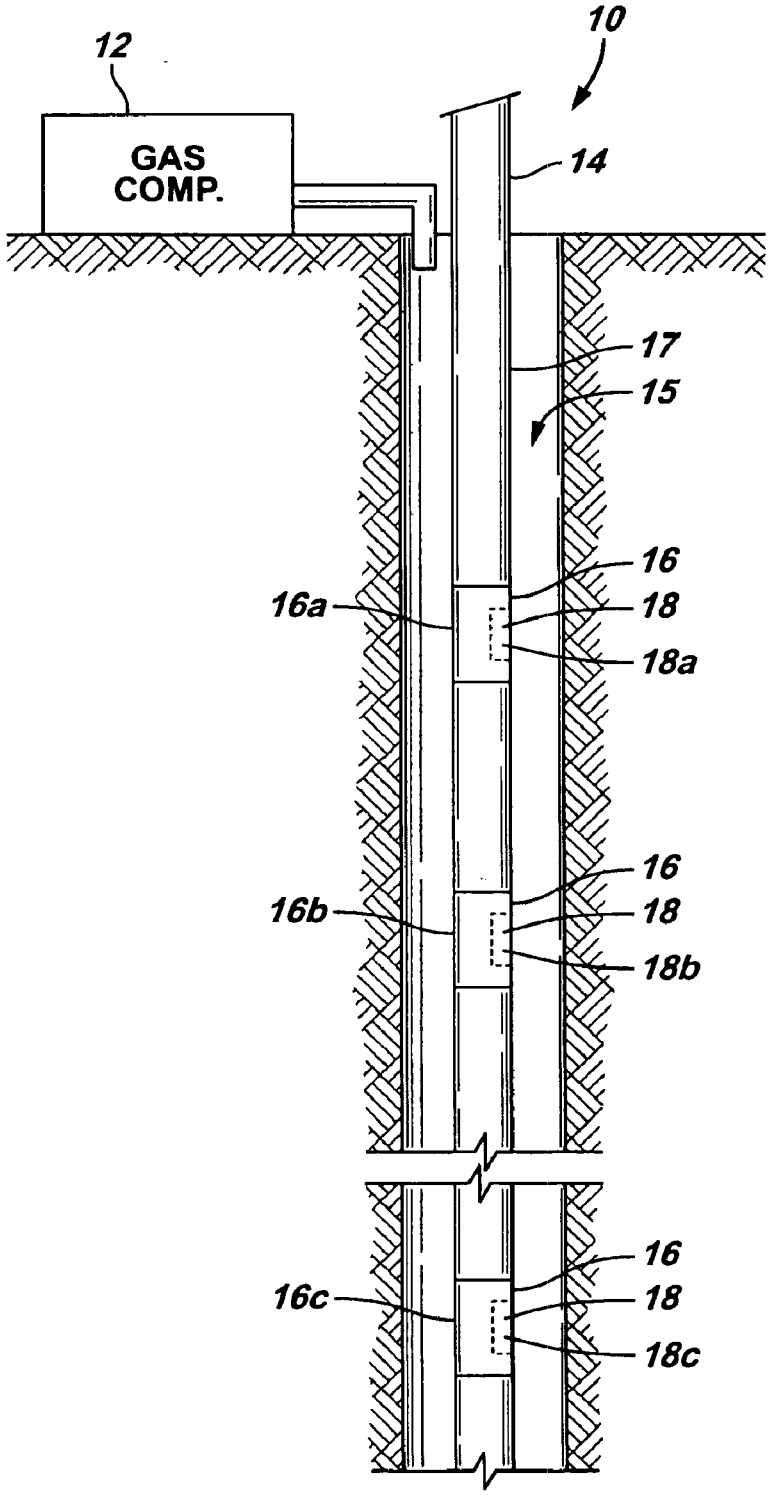
FIG. 1 (Prior Art)
FIG. 1 is a schematic diagram of a gas lift system according to the prior art.
Figure 2:
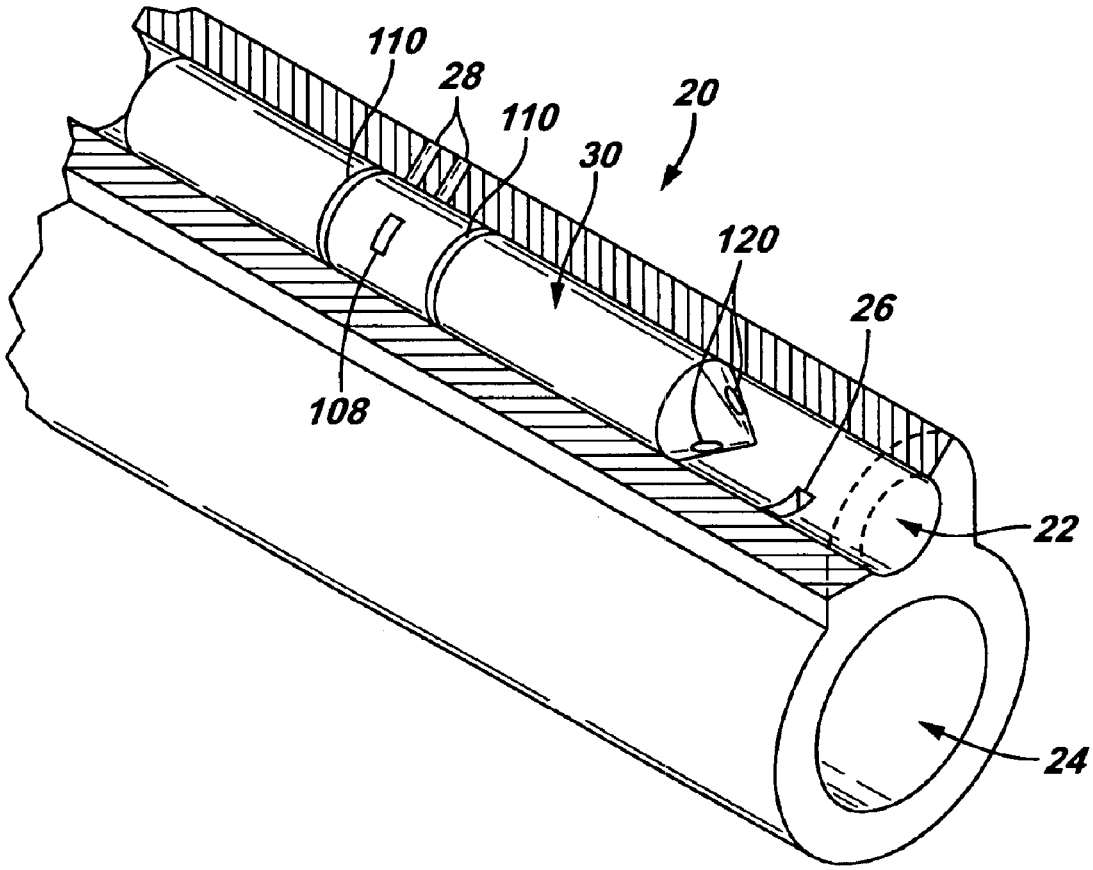
FIG. 2 is a schematic diagram of a portion of a gas lift mandrel according to an embodiment of the invention.

Referring to FIG. 2, an embodiment 20 of a gas lift mandrel in accordance with the invention is constructed to be installed in a production tubing (not shown) for purposes of controlling the introduction of gas into a central passageway of the production tubing. As shown, the gas lift mandrel 20 includes two generally cylindrical passageways 22 and 24, each of which has a longitudinal axis that is parallel to the longitudinal axis of the production tubing. More particularly, the passageway 24 is coaxial with the longitudinal axis of the production tubing, as the passageway 24 forms part of the central passageway of the production tubing. The passageway 22 is eccentric to the passageway 24 and houses a gas lift valve 30.

The purpose of the gas lift valve 30 is to selectively control fluid communication between an annulus of the well and the central passageway of the production tubing so that gas may be introduced into the production tubing at the location of the gas lift valve 30. The term "annulus" refers to the annular region that surrounds the exterior of the production tubing. For a cased wellbore, the "annulus" may include the annular space, or region, between the interior surface of the casing string and the exterior surface of the production tubing. The gas lift valve 30 may be part of a gas lift system. In such a system, a gas may be introduced into the well annulus so that one or more of the gas lift valves 30 (that are installed in the production tubing) may be operated for purposes of introducing the gas into the central passageway of the production tubing, as can be appreciated by one skilled in the art.

More specifically, the function of the gas lift valve 30 is to control communication between its one or more inlet ports 108 and its one or more output ports 120. The gas lift mandrel 20 includes one or more inlet ports 28 that are in communication with the annulus; and the gas lift valve 30 includes seals (O-rings, MSE seals, or T-seals, for example) 110 that straddle the inlet port(s) 28 and inlet ports 108 for purposes creating a sealed region for the gas lift valve 30 to receive fluid from the annulus. The outlet port(s) 120 are in communication with one or more outlet ports 26 formed in the mandrel 20 between the passageways 22 and 24. Thus, due to this arrangement, when the gas lift valve 30 is open, gas flows from the annulus, through the ports 28, 108, 120 and 26 (in the listed order) and into the passageway 24. When the gas lift valve 30 is closed, the gas lift valve 30 blocks communication between the ports 108 and 120 to isolate the passageway 24 from the annulus.

In general, the gas lift valve 30 transitions between its open and closed states in response to annulus or tubing pressure. Typically, if the gas lift valve 30 is an injection pressure operated (IPO) valve it is responsive to annulus pressure. If the gas lift valve 30 is a production pressure operated (PPO) valve, it is typically responsive to tubing pressure. When the annulus or tubing pressure exceeds a predefined threshold, the gas lift valve 30 opens; and otherwise, the gas lift valve 30 closes. In some embodiments of the invention, this predefined threshold may be established by the presence of a gas charge in the gas lift valve 30, as further described below.

Figure 3:
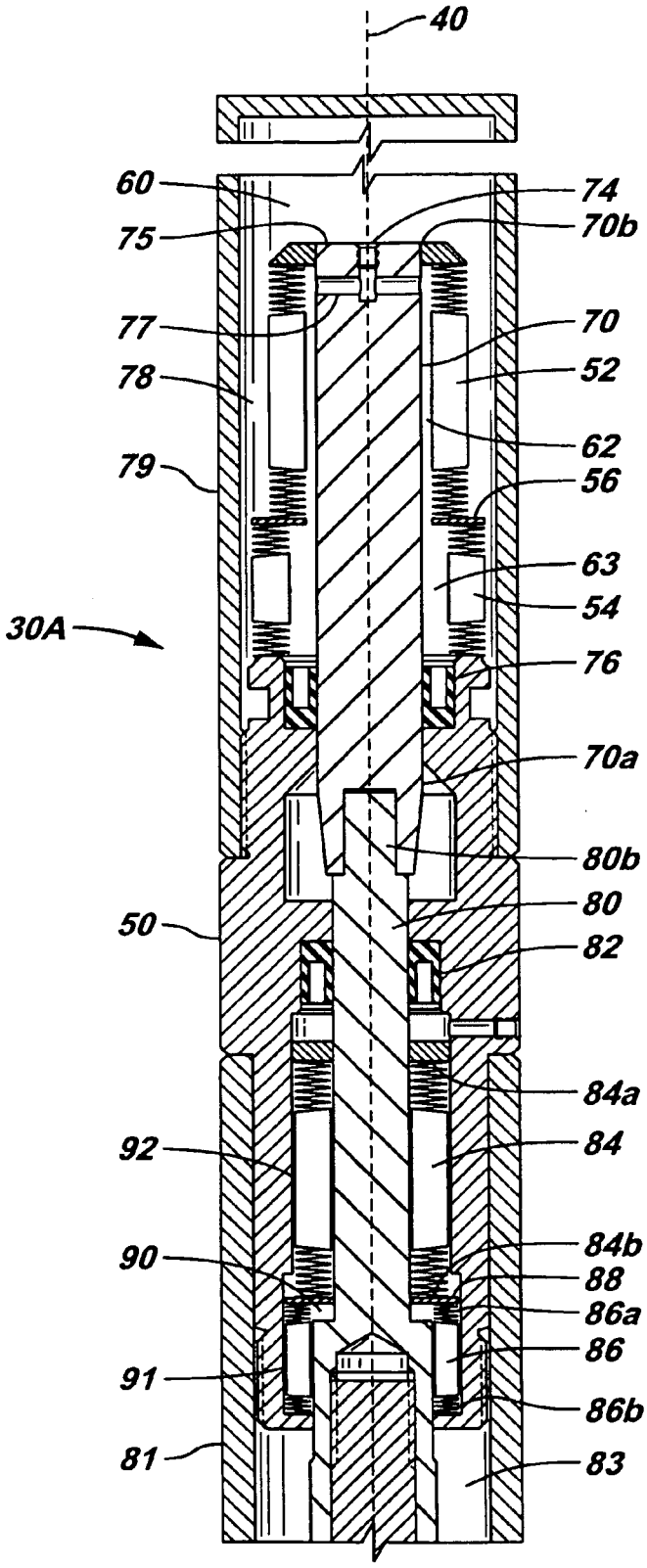
FIG. 3 is a schematic diagram of a middle portion of a gas lift valve according to an embodiment of the invention.
Figure 4:
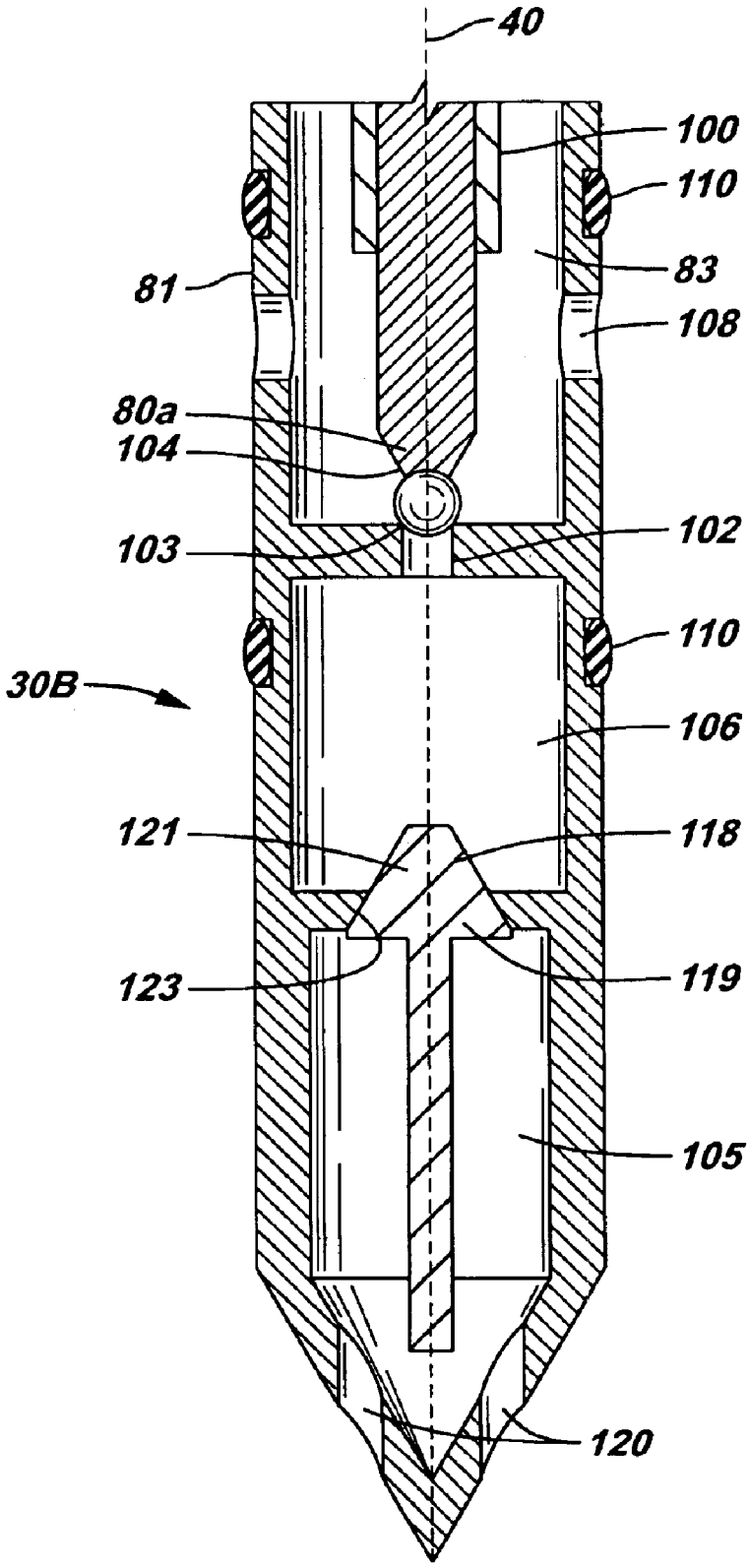
FIG. 4 is a schematic diagram of a lower portion of the gas lift valve according to an embodiment of the invention.

A more specific embodiment of the gas lift valve 30 is illustrated in FIGS. 3 and 4. In this manner, FIG. 3 depicts a middle section 30A of the gas lift valve 30, and FIG. 4 depicts a lower section 30B of the gas lift valve.

Referring to FIG. 3, in some embodiments of the invention, the gas lift valve 30 includes a pressure or reservoir 60 that forms part of a gas charge section of the gas lift valve 30, a section that establishes a bias to keep the gas lift valve 30 closed and a predefined annulus threshold that must be overcome to open the valve 30. More specifically, in some embodiments of the invention, the reservoir 60 may be filled with an inert gas, such as Nitrogen, that exists in the reservoir 60 for purposes of exerting a closing force on a gas stem 70 of the gas lift valve 30.

The gas stem 70 and a fluid stem 80 (of the valve 30) collectively form a valve stem for the gas lift valve 30. Assuming the gas lift valve 30 is closed, the valve stem moves in an upward direction to open the gas lift valve 30; and assuming the gas lift valve 30 is open, the valve stem moves in a downward direction to close the gas lift valve 30. More specifically, the gas stem 70 is coaxial with the longitudinal axis 40 of the gas lift valve 30 and is connected at its lower end 70*a* to the upper end 80*b* of the fluid stem 80. The fluid stem 80 is also coaxial with the longitudinal axis 40 of the gas lift valve 30. It is noted that the cross-sectional diameters of the gas 70 and fluid 80 stems are different. This relationship permits a lower pressure to be used in the reservoir 60, as further described below.

It is important to note that although the embodiment shown in FIG. 3 shows the gas stem 70 affixed to the fluid stem 80, in alternate embodiments, the gas stem 70 and fluid stem 80 are separated parts that are coupled together by pressure during activation. In further alternate embodiment, the gas stem 70 and the fluid stem 80 are manufactured as a single part. Referring also to FIG. 4, near its lower end 80*a*, the fluid stem 80 has a ball-type tip 104 that, when the gas lift valve 30 is closed, forms a seal with a valve seat 103 for purposes of closing off communication through a port 102 of the gas lift valve 30. Because all communication between the inlet 108 and outlet 120 ports occurs through the port 102, the gas lift valve 30 is closed when the tip 104 is seated in the valve seat 103. This condition occurs when the valve stem is at its farthest point of downward travel. Conversely, the gas lift valve 30 is open when the valve stem is raised and the tip 104 is not seated in the valve seat 103.

Referring to FIG. 3, the gas pressure inside the reservoir 60 acts on a top surface 75 of the gas stem 70 to create a downward force on the valve stem. This downward force, in turn, tends to keep the gas lift valve 30 closed in the absence of a greater opposing force that may be developed by the annulus or tubing pressure on the valve stem (as described below).

The gas reservoir 60 is formed from an upper housing section 79 that contains a chamber 78 (of the gas lift valve 30) for storing the gas in the reservoir 60. The chamber 78 may also house the gas stem 70 and an upper bellows assembly, described below. The upper housing section 79 is connected to a middle housing section 50 of the gas lift valve 30.

The gas lift valve 30 includes an upper bellows assembly that forms a flexible seal between the gas stem 70 and the middle housing section 50 to accommodate movement of the valve stem. In some embodiments of the invention, the upper bellows assembly may include a seal bellows 52 and a compensation bellows 54, both of which are coaxial with and circumscribe the gas stem 70. The seal 52 and compensation 54 bellows are located inside the chamber 78, as depicted in FIG. 3.

As shown, the seal bellows 52 is located closer to the upper end 70*b* of the gas stem 70 than to the lower end 70*a* of the gas stem 70; and the seal bellows 52 circumscribes this upper portion of the gas stem 70. The upper end of the seal bellows 52 is connected to the upper end 70*b* of the gas stem 70, and the lower end of the seal bellows 52 is connected to an annular plate 56.

The compensation bellows 54 circumscribes the lower part of gas stem 70 and has a larger diameter than the seal bellows 52. The upper end of the compensation bellows 54 is connected to the annular plate 56, as the plate 56 radially extends between the upper end of the compensation bellows 54 and the lower end of the seal bellows 52. The lower end of the compensation bellows 54 is attached to the middle housing section 50.

It should be understood that in alternate embodiments, the relative location of the seal bellows 52 and the compensation bellows 54 along the gas stem 70 can be inverted. For example, the compensation bellows 54 can be located closer to the upper end 70*b* of the gas stem 70, while the seal bellows circumscribes the lower part of the gas stem 70.

In the embodiment shown, when the gas stem 70 (and thus, the valve stem) moves in a downward direction, the compensation bellows 54 longitudinally expands and the seal bellows 52 longitudinally compresses. Conversely, when the gas stem 70 moves in an upward direction, the compensation bellows 54 longitudinally compresses and the seal bellows 52 longitudinally expands.

The pressure that is exerted on the bellows 52 and 54 by the gas inside the reservoir 60 may cause a significant pressure differential across the walls of the seal bellows 52 and across the walls of the compensation bellows 54, if not for the pressure balancing features of the gas lift valve 30. In some embodiments of the invention, the pressure balancing features include an incompressible fluid that is contained inside the bellows 52 and 54.

More specifically, in some embodiments of the invention, the incompressible fluid is contained within annular spaces 62 and 63. The walls of the seal bellows 52 define the annular region 62, a region that is located between the interior surface of the seal bellows 52 and the adjacent exterior surface of the gas stem 70. The walls of the compensation bellows 54 define the annular region 63, a region that is located between the interior surface of the seal bellows 54 and the adjacent exterior surface of the gas stem 70. The two regions 62 and 63 are isolated by the bellows 52 and 54 from the gas in the reservoir 60 and are in communication so that the incompressible fluid may move between the regions 62 and 63 when the bellows 52 and 54 are compressed/decompressed.

The incompressible fluid serves to remove any pressure differential that otherwise exists across the walls of the bellows 52 and 54 due to the pressure that is exerted by the gas in the reservoir 60. More specifically, the incompressible fluid is a non-compressible fluid that exerts forces (on the interior surface of the walls of the bellows 52 and 54) that are equal and opposed to the forces on the outer surfaces of the walls of the bellows 52 and 54 (exerted by the gas in the reservoir 60).

In operation, when the gas stem 70 moves in a downward direction, the compensation bellows 54 expands and the seal bellows 52 compresses. Therefore, some of the incompressible fluid contained within the seal bellows 52 is displaced into the compensation bellows 54, as the volume of incompressible fluid remains constant. When the gas stem 70 moves in an upward direction, the compensation bellows 54 compresses and the seals bellows 52 expands. Some of the incompressible fluid contained within the compensation bellows 54 is displaced into the seal bellows 52, as the volume of the incompressible fluid remains constant. Thus, regardless of the positions of the bellows 52 and 54, the incompressible fluid remains inside the bellows 52 and 54 to compensate forces that are exerted by the gas inside the reservoir 60.

To summarize, the bellows 52 and 54 and the incompressible fluid establish a pressure compensation system to equalize the pressure difference across the walls of the bellows 52 and 54. The result is that the bellows 52 and 54 transfer a more uniform load to the incompressible fluid, and consequently to the seal 76.

Among the other features of the gas charge section of the gas lift valve 30, the gas lift valve 30 may include, in some embodiments of the invention, a fluid fill port 74 for purposes of introducing the incompressible fluid into the annular regions 62 and 63. The fill port 74 may be located, for example, in the top surface of the gas stem 70 and may be in communication with the annular regions 62 and 63 via one or more passageways 77 that are formed in the gas stem 70. The gas lift valve 30 also includes an annular seal 76 that closely circumscribes the exterior surface of the gas stem 70 to form a seal between the annular regions 62 and 63 and the middle housing section 50 for purposes of sealing the incompressible fluid inside the bellows 52 and 54. The gas lift valve 30 also includes another annular seal 82 for purposes of forming a seal between the exterior surface of the fluid stem 80 and the incompressible fluid used for purposes of equalizing, or balancing, pressures that are exerted on bellows on the well fluid section part of the gas lift valve, described below.

Turning to the well fluid section of the gas lift valve 30, in some embodiments of the invention, this section includes a lower bellows assembly. This lower bellows assembly includes an upper seal bellows 84 and a lower compensation bellows 86, both of which are coaxial with the longitudinal axis 40 of the gas lift valve 30. The seal bellows 84 has a top end 84*a* that is connected to the fluid stem 80. A radially extending annular plate 88 connects the lower end 84*b* of the seal bellows 84 to the upper end 86*a* of the compensation bellows 86. The lower end 86*b* of the compensation bellows 86, in turn, is connected to the middle housing section 50. As discussed above with regard to the upper bellows assembly, in alternate embodiments, the orientation of the upper seal bellows 84 and the lower compensation bellows 86 can be reversed.

As depicted in FIG. 3, the seal bellows 84 circumscribes part of the fluid stem 80 and has a smaller diameter than the diameter of the compensation bellows 86. The compensation bellow 86 circumscribes a lower portion of the fluid stem 80.

Fluid from the well annulus is in communication with an annular region 90 that exists between the exterior surface of the fluid stem 80 and the interior wall surfaces of the bellows 84 and 86. This annular region 90 is in communication with a fluid chamber 83 formed in a lower housing section 81 of the gas lift valve 30. The lower housing section 81 is connected to the middle housing section 50, and in addition to establishing the fluid chamber 83, the lower housing section 81 contains the lower bellows assembly and fluid stem 80.

An annular region 92 exists between the outer surface of the wall of the seal bellows 84 and the inner surface of the middle housing 50; and an annular region 91 exists between the outer surface of the wall of the compensation bellows 86 and the inner surface of the middle housing 50. Both regions 91 and 92 contain the incompressible fluid for purposes of equalizing the pressure across the walls of the bellows 84 and 86, in a similar arrangement to that described for the bellows 52 and 54 with the exception that here, the incompressible fluid is located outside of the bellows walls and the fluid that exerts the forces on the bellows walls is located inside of the bellows walls.

In operation, when the fluid stem 80 moves in a downward direction, the bellows 84 compresses, thereby evacuating the incompressible fluid from the annular region 91 into the annular region 92. During the compression of the bellows 84, the bellows 86 expands to compensate the incompressible fluid that is displaced from the compressed annular region 91. Conversely, when the fluid stem 80 moves in an upward direction, the bellows 86 compresses, and fluid that is displaced from the region 92 enters the region 91 as the bellows 84 expands. By maintaining a constant volume of the incompressible fluid, the differential pressure across the walls of the bellows 84 and 86 is eliminated.

As described above, the pressure of the gas in the reservoir 60 tends to force the valve stem (i.e., the gas 70 and fluid 80 stems) in a downward direction. However, the pressure that is exerted by fluid in the annulus of the well exerts an upward force on the gas 70 and fluid 80 stems, tending to push the stems 70 and 80 in an upward direction.

Therefore, the pressure inside the reservoir 60 establishes a predefined threshold that must be overcome for the gas stem 70 and the fluid stem 80 to move in an upward direction to open the gas lift valve 30.

In some embodiments of the invention, the diameter of the seal 76 of the gas stem 70 is larger than the diameter of the seal 82 of the fluid stem 80. This means that for a given pressure level for the reservoir 60, more downward force is developed on the valve stem than the upward force that is developed on the valve stem for the same pressure level for the annulus fluid. Thus, the above-described relationship of seal diameters between the gas 70 and fluid 80 stems intensifies the pressure that is exerted by the gas in the reservoir 60 with respect to the pressure that is exerted by the annulus or tubing fluid. Such intensifier relationship enables the use of lower charge pressure based on a given annulus or tubing pressure.

Referring to FIG. 4, among its other features, in some embodiments of the invention, the gas lift valve 30 includes the radial ports 108 (see also FIG. 2) that are formed in the lower housing section 81 for purposes of establishing fluid communication between the annulus and the fluid chamber 83. The bottom end of the valve stem, i.e., the tip 104, controls communication of the annulus fluid through the port 102, a port that establishes communication between the fluid chamber 83 and an intermediate chamber 106. Thus, when the gas 70 and fluid 80 stems are retracted in an upward direction, the tip 104 is moved off of the valve seat 103 to permit fluid communication between the chambers 83 and 106.

A one-way communication path exists between the intermediate chamber 106 and an exit chamber 105, a chamber 105 in which the outlet ports 120 (see also FIG. 2) are formed. In this manner the one-way communication path is effectively established by a check valve, a valve that ensures that annulus fluid flows from the chamber 106 into the production tubing and does not flow from the production tubing into the annulus.

The check valve opens in response to annulus pressure so that fluid flows from the annulus through a port 119 that exists between the chambers 106 and 105. In some embodiments of the invention, the check valve may include a valve stem 118 that has a tip 121 that seats in a valve seat 123 for purposes of preventing fluid from flowing in the reverse direction through the port 119. Thus, a differential force that would cause fluid to flow from the production tubing into the annulus forces the tip 121 into the valve seat 123 to block communication through the port 119. Conversely, a differential force that would cause fluid to flow from the annulus into the production tubing removes the tip 121 from the valve seat 123 to permit communication through the port 119.

Figure 5:
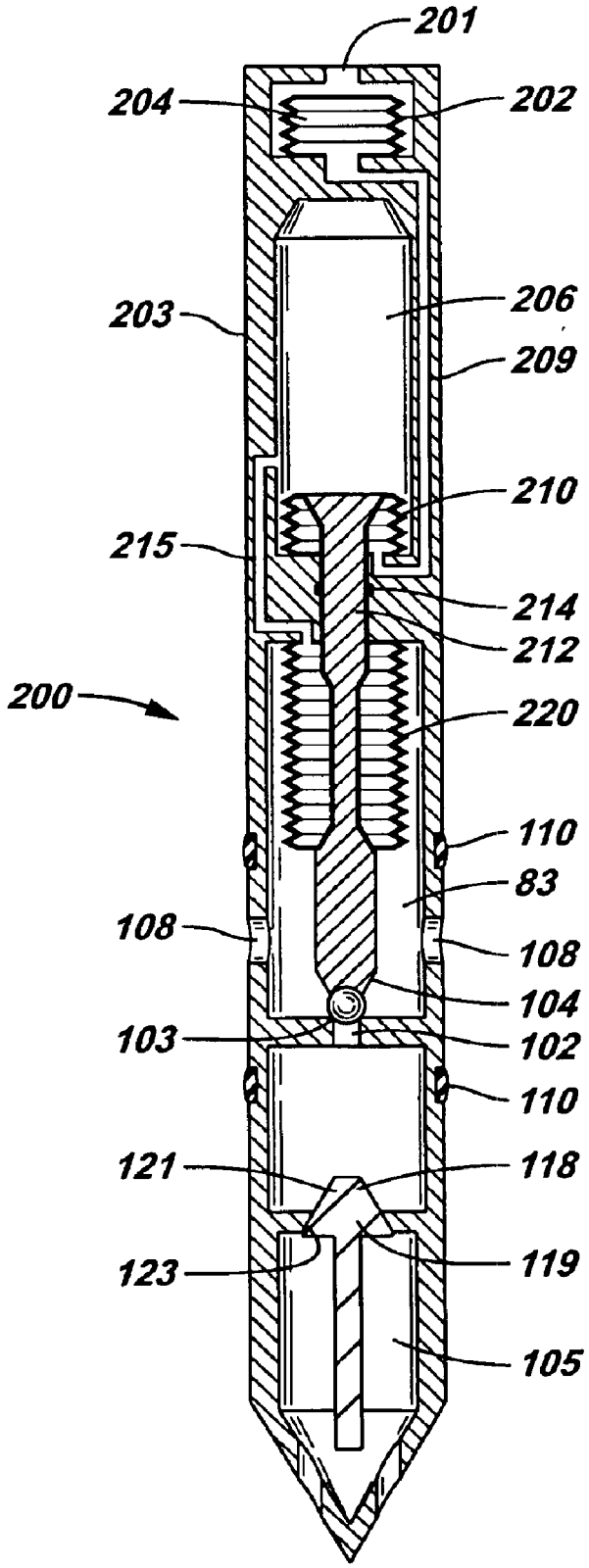
FIGS. 5 and 6 are schematic diagrams of gas lift valves according to other embodiments of the invention.

Referring to FIG. 5, in some embodiments of the invention, the gas lift valve 30 may be replaced by a gas lift valve 200. Components (of the gas lift valve 200) that are similar to components of the gas lift valve 30 are denoted by similar reference numerals.

Unlike the gas lift valve 30, the gas lift valve 200 includes a tubing pressure assist mechanism for purposes of using pressure in the central passageway of the production tubing to assist in opening the gas lift valve 200. Such a system may be beneficial when a relatively lower pressure is used in the annulus for purposes of opening the gas lift valve.

More specifically, in some embodiments of the invention, the gas lift valve 200 includes a tubing assist bellows 202 that is in communication with the central passageway of the production tubing so that the tubing pressure compresses the bellows 202. The exterior of the bellows 202 is in communication with a port 201 that, in turn, communicates with the tubing fluid.

The bellows 202 contains a fluid (an incompressible fluid, for example) that is in communication (via a communication line 209) to an interior space of another bellows 210. The bellows 210, in turn, is connected to a valve stem 212 so that when the bellows 202 compresses (due to the force exerted due to the tubing pressure), the fluid enters the bellows 210 to expand the bellows 210. This expansion, in turn, lifts the stem 212 to open the gas lift valve 200 to allow communication between the well annulus and the production tubing.

The tendency of the bellows 210 to expand and open the gas lift valve 30 in response to the tubing pressure is countered by a charge pressure that exists inside an internal charge reservoir 206 of the valve 200. In this manner, the bellows 210 is contained inside the reservoir 206 so that the gas inside the reservoir 206 exerts a force on the exterior surface of the bellows 210. Thus, the predefined threshold established by the charge 206 must be overcome to allow the bellows 210 to expand by a sufficient amount to limit the stem 212 to lift the stem 212 to open the gas lift valve 200.

In some embodiments of the invention, the charge reservoir 206 is in communication (via a pressure line 215) to a space inside another bellows 220. In this manner, gas from the reservoir 206 may work to expand the bellows 220. When expanded, the bellows 220 tends to move the stem 212 in a downward direction to close the gas lift valve 200. However, the tendency of the bellows 220 to expand is countered by pressure in the well annulus. In this regard, the exterior of the bellows 220 is in communication with the well annulus via radial inlet ports 108.

Figure 6:
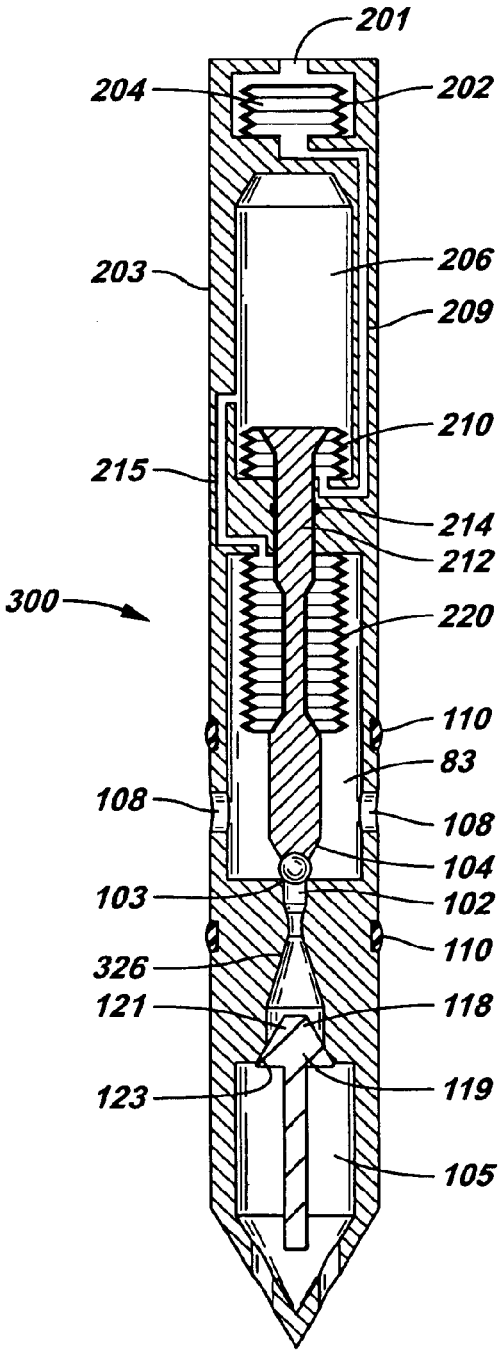

In some embodiments of the invention, the gas lift valves 30 and 200 may be replaced by a gas lift valve 300 that is depicted in FIG. 6. Components (of the gas lift valve 300) that are similar to components of the gas lift valves 30 and 200 are denoted by similar reference numerals.

Unlike the gas lift valves described above, the gas lift valve 300 includes a venturi orifice 326 between the ports 102 and 119 for purposes of minimizing the pressure drop and the turbulence in the flow of gas from the well annulus to the central passageway of the production tubing.

Other embodiments are within the scope of the following claims. For example, in the embodiments described above, for each set of seal and compensation bellows, a seal (seals 76 and 82, for example) was located in the body, or housing, of the gas lift valve assembly to form a seal between a rod, or stem (stems 70 and 80, for example) and the housing. This arrangement kept the volume of incompressible fluid contained within the bellows constant. However, in other embodiments of the invention, the seal may be located in, or secured to, the rod so that the seal moves with the rod.

Figure 7:
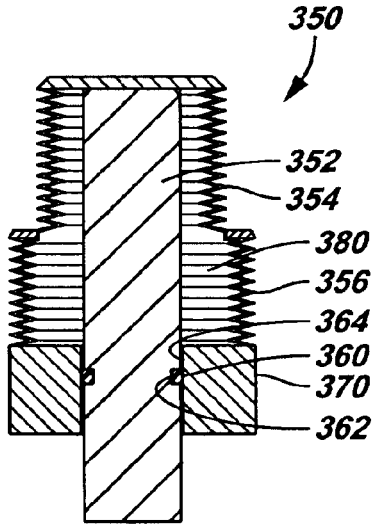
FIG. 7 is a schematic diagram of a bellows assembly in accordance with another embodiment of the invention.

As a more specific example, FIG. 7 depicts an exemplary bellows assembly 350 according to another embodiment of the invention. The assembly 350 includes a seal bellows 354, a compensation bellows 356 and a stem, or rod 352, to expand and compress the bellows 354 and 356, as described above in the other embodiments described herein. However, unlike these other embodiments, a seal 360 (an O-ring seal, for example) is attached to, or located in, the rod 352 so that the seal 360 moves with the rod 352.

More particularly, the seal 360 is located inside an annular groove 362 of the rod 352 and forms a seal between the exterior surface of the rod and an interior surface of a housing 370. This interior surface of the housing 370 defines a passageway 364 through which the rod 352 slides. The seal 360 maintains an incompressible fluid 380 within the interior regions defined by the seal 354 and compensation 356 bellows.

Unlike the embodiments in which the seal is located in the housing, the seal 360 in the assembly 350 moves with the rod 352. This arrangement affects the movement of the bellows 354 and 356, since the movement of the seal 360 with the rod 352 forces the volume of fluid 380 into the interior regions that are defined by the bellows 354 and 356. In response to the rod 352 moving in an upward direction, the seal 354 and compensation 356 bellows move in upward directions. The rates at which the seal 354 and compensation 356 bellows move is different.

Thus, by placing the seal 360 on the rod 352, the movement of the bellows 352 and 354 follows the movement of the rod 352. The internal regions that are defined by the seal 354 and compensation 356 bellows is still filled with the incompressible fluid 380 that transfers the pressure loads to the seal 360, allowing the bellows to see no differential loading.

In the preceding description, directional terms, such as "upper," "lower," "vertical," "horizontal," etc. may have been used for reasons of convenience to describe the gas lift valve and its associated components. However, such orientations are not needed to practice the invention, and thus, other orientations are possible in other embodiments of the invention. For example, the gas lift valve and its associated components, in some embodiments in some embodiments of the invention, may be tilted by approximately 90° to the orientations depicted in the figures.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A gas lift valve for use in a subterranean well comprising:

a housing having an upper chamber and a lower chamber therein and an inlet port therethrough to allow fluid communication between the exterior of the housing and the lower chamber;

a valve stem moveably and sealingly mounted in the interior of the housing, the valve stem having an upper end extending into the upper chamber and a lower end extending into the lower chamber, the lower end being selectively and sealably engagable in a valve seat; and an upper bellows assembly sealingly mounted around the upper end of the valve stem to prevent fluid communication between the interior of the upper bellows assembly and the upper chamber, the upper bellows assembly comprising a first fluid therein and comprising an upper end attached to the upper end of the valve stem and a lower end attached to a first interior surface of the housing.

2. The gas lift valve of claim 1 in which the upper bellows assembly comprises a first upper bellows and a second upper bellows, the first upper bellows and second upper bellows having different diameters.

3. The gas lift valve of claim 1 in which the first fluid is incompressible.

4. The gas lift valve of claim 1 in which the upper bellows assembly comprises a first upper bellows and a second upper bellows, and one of the first upper bellows and second upper bellows compresses and the other of the first upper bellows and the second upper bellows expands in response to the valve stem moving in a given direction.

5. The gas lift valve of claim 1 in which the upper bellows assembly comprises a first upper bellows and a second upper bellows, and in which:

the first upper bellows circumscribes a first portion of the interior of the upper bellows assembly and contains a first volume of the first fluid;

the second upper bellows circumscribes a second portion of the interior of the upper bellows assembly and contains a second volume of the first fluid; and the first volume of the first fluid changes in an inverse relationship to the second volume of the first fluid in response to the movement of the valve stem.

6. The gas lift valve of claim 1 in which the sealingly mounted valve stem has an upper fluid seal element located between the valve stem and the housing.

7. The gas lift valve of claim 6 in which the upper fluid seal element is adapted to move with the valve stem.

8. The gas lift valve of claim 6 in which the upper fluid seal element is secured to the housing.

9. The gas lift valve of claim 1 in which the upper bellows assembly comprises a first upper bellows and a second upper bellows, and each of the first upper bellows and second upper bellows compresses or expands proportionally in response to the valve stein moving in a given direction.

10. The gas lift valve of claim 1 in which the upper bellows assembly comprises a first upper bellows and a second upper bellows, and in which:

the first upper bellows circumscribes a first portion of the interior of the upper bellows assembly and contains a first volume of the first fluid;

the second upper bellows circumscribes a second portion of the interior of the upper bellows assembly and contains a second volume of the first fluid; and the first volume of the first fluid changes in direct proportion to the second volume of the first fluid in response to the movement of the valve stem.

11. The gas lift valve of claim 1 further comprising a second fluid in the upper chamber.

12. The gas lift valve of claim 11 in which the second fluid applies a closing force on the valve stem.

13. The gas lift valve of claim 11 in which the second fluid is a gas.

14. The gas lift valve of claim 1 further comprising a lower bellows assembly sealingly mounted around the lower end of the valve stem to prevent fluid communication between the interior of the lower bellows assembly and the lower chamber, the lower bellows assembly having a second fluid therein.

15. The gas lift valve of claim 14 in which the lower bellows assembly has an upper end attached to the lower end of the valve stem and a lower end attached to a second interior surface of the housing.

16. The gas lift valve of claim 14 in which the lower bellows assembly comprises a first lower bellows and a second lower bellows, the first lower bellows and second lower bellows having different diameters.

17. The gas lift valve of claim 14 in which the second fluid is incompressible.

18. The gas lift valve of claim 14 in which the lower bellows assembly comprises a first lower bellows and a second lower bellows, and one of the first lower bellows and second lower bellows compresses and the other of the first lower bellows and the second lower bellows expands in response to the valve stem moving in a given direction.

19. The gas lift valve of claim 14 in which the lower bellows assembly comprises a first lower bellows and a second lower bellows, and in which:

the first lower bellows circumscribes a first portion of the interior of the lower bellows assembly and contains a first volume of the second fluid;

the second lower bellows circumscribes a second portion of the interior of the lower bellows assembly and contains a second volume of the second fluid; and the first volume of the second fluid changes in an inverse relationship to the second volume of the second fluid in response to the movement of the valve stem.

20. The gas lift valve of claim 14 in which the sealingly mounted valve stem has a lower fluid seal element located between the valve stem and the housing.

21. The gas lift valve of claim 20 in which the lower fluid seal element is adapted to move with the valve stem.

22. The gas lift valve of claim 20 in which the lower fluid seal element is secured to the housing.

23. The gas lift valve of claim 14 in which the lower bellows assembly comprises a first lower bellows and a second lower bellows, and each of the first lower bellows and second lower bellows compresses or expands proportionally in response to the valve stem moving in a given direction.

24. The gas lift valve of claim 14 in which the lower bellows assembly comprises a first lower bellows and a second lower bellows, and in which:

the first lower bellows circumscribes a first portion of the interior of the lower bellows assembly and contains a first volume of the second fluid;

the second lower bellows circumscribes a second portion of the interior of the lower bellows assembly and contains a second volume of the second fluid; and the first volume of the second changes in direct proportion to the second volume of the second in response to the movement of the valve stem.

25. The gas lift valve of claim 1 further comprising a second fluid exterior to the housing and in the lower chamber.

26. The gas lift valve of claim 25 in which the second fluid applies an opening force on the valve stem.

27. The gas lift valve of claim 25 in which the second fluid comprises a gas.

28. The gas lift valve of claim 1 in which the housing has a passageway in fluid communication with the lower chamber when the gas lift valve is in an open state.

29. The gas lift valve of claim 28 further comprising a check valve in the passageway.

30. The gas lift valve of claim 29 in which the check valve positively seals to prevent flow through the passageway.

31. The gas lift valve of claim 28 in which the passageway is in fluid communication with an outlet port.

32. The gas lift valve of claim 1 in which the diameter of the lower end of the valve stem is different from the diameter of the upper end of the valve stem.

33. A method to inject a fluid into a tubing in a subterranean well comprising:

providing a gas lift valve having a valve stem, a valve seat, and a bellows assembly in a housing, the housing having a chamber containing a first fluid to exert a downward force on an upper end of the valve stem, the bellows assembly having a second fluid therein isolated from the first fluid and comprising an upper end attached to an upper end of the valve stem and a lower end attached to an interior surface of the housing;

injecting pressurized fluid into an annular region between the tubing and a wall of the well to apply an upward force on a lower end of the valve stem;

opening the valve when the upward force exceeds the downward force;

passing the injected fluid through an orifice in the valve seat and into the tubing.

34. The method of claim 33 further comprising passing the injected fluid through a check valve before passing it into the tubing.

35. The method of claim 34 further comprising overcoming a positive seal formed by the check valve to pass the injected fluid through the check valve.

36. A gas lift valve usable with a subterranean well, comprising:

a housing having a port in communication with a first fluid;

a valve stem responsive to the first fluid to establish a predefined threshold to open the valve; and a bellows assembly to form a seal between the valve stem and the housing, the bellows assembly comprising a first bellows having a first diameter and a second bellows having a second diameter different from the first diameter, wherein the first bellows compresses and the second bellows expands in response to the valve stern moving in a first direction, and the first bellows expands and the second bellows compresses m response to the valve stem moving a second direction opposite from the first direction.

37. The valve of claim 36, wherein the bellows assembly contains a second fluid sealed off from the well.

38. The valve of claim 37, wherein the second fluid comprises a non-compressible fluid.

39. The valve of claim 36, wherein the first bellows circumscribes a first annular space containing a first volume of a second fluid, the second bellows circumscribes a second annular space containing a second volume of the second fluid, and the first volume changes in an inverse relationship to the second volume in response to movement of the valve stem.

40. The valve of claim 36, wherein the first bellows is located uphole of the second bellows, an uphole end of the first bellows is connected to an uphole end of the valve stem, and a downhole end of the second bellows is connected to an interior surface of the housing.

41. A gas lift valve usable with a subterranean well, comprising:

a gas charge chamber;

a well fluid chamber;

a valve stem;

a first bellows assembly to form a fluid seal between the gas charge chamber and the valve stem; and a second bellows assembly to form a fluid seal between the well fluid chamber and the valve stem, wherein at least one of the first and second bellow assemblies comprises bellows that have different diameters, and a downhole end of the first bellows assembly is connected to and moves with an uphole end of the second bellows assembly.

42. The gas lift valve of claim 41, wherein the first bellows assembly contains a fluid sealed off from the well and the second bellows assembly is surrounded by another fluid sealed from the well.

43. The gas lift valve of claim 41, wherein bellows of the first bellows assembly have different diameters and bellows of the second bellows assembly have different diameters.

44. A method usable with a subterranean well, comprising:

providing a first bellows having a first diameter and a second bellows having a second diameter different from the first diameter, at least one of the first and second bellows being connected to a valve stem of a gas lift valve; and configuring the first bellows and the second bellows so that the first bellows compresses and the second bellows expands in response to the valve stem moving in a first direction, and the first bellows expands and the second bellows compresses in response to the valve stem moving in a second direction opposite from the first direction.

45. The method of claim 44, wherein the first and second bellows provide a seal between the valve stem and a gas charge chamber.

46. The method of claim 44, wherein the first and second bellows provide a seal between the valve stem and a well fluid chamber.

47. A gas lift valve for use in a subterranean well comprising:

a housing having an upper chamber and a lower chamber therein and an inlet port therethrough to allow fluid communication between the exterior of the housing and the lower chamber;

a valve stem moveably and sealingly mounted in the interior of the housing, the valve stem having an upper end extending into the upper chamber and a lower end extending into the lower chamber, the lower end being selectively and sealably engagable in a valve seat; and an upper bellows assembly sealingly mounted around the upper end of the valve stem to prevent fluid communication between the interior of the upper bellows assembly and the upper chamber, the upper bellows assembly having a first fluid therein and comprising a first upper bellows and a second upper bellows, wherein the first upper bellows circumscribes a first portion of the interior of the upper bellows assembly and contains a first volume of the first fluid, the second upper bellows circumscribes a second portion of the interior of the upper bellows assembly and contains a second volume of the first fluid, and the first volume of the first fluid changes in an inverse relationship to the second volume of the first fluid in response to the movement of the valve stem.

48. The gas lift valve of claim 47 in which the upper bellows assembly has an upper end attached to the upper end of the valve stem and a lower end attached to a first interior surface of the housing.

49. The gas lift valve of claim 47 in which the upper bellows assembly comprises a first upper bellows and a second upper bellows, the first upper bellows and second upper bellows having different diameters.

50. The gas lift valve of claim 47 in which the first fluid is incompressible.

* * * * *